US008800257B2

(12) United States Patent
Rebouillat et al.

(10) Patent No.: US 8,800,257 B2
(45) Date of Patent: Aug. 12, 2014

(54) COMPOSITE CORD AND METHOD OF MAKING AND SUPPORT STRUCTURE AND TIRE CONTAINING SAME

(75) Inventors: Serge Rebouillat, Echenevex (FR); Olivier Rozant, Cernex (FR); Frederic Fleury, Geneva (CH)

(73) Assignee: E I du Pont de Nemours and Company, Wilmington, DE (US)

( * ) Notice: Subject to any disclaimer, the term of this patent is extended or adjusted under 35 U.S.C. 154(b) by 233 days.

(21) Appl. No.: 13/182,717

(22) Filed: Jul. 14, 2011

(65) Prior Publication Data

US 2012/0180926 A1 Jul. 19, 2012

Related U.S. Application Data

(60) Provisional application No. 61/364,930, filed on Jul. 16, 2010.

(51) Int. Cl.
*D02G 3/48* (2006.01)

(52) U.S. Cl.
CPC ..... *D02G 3/48* (2013.01); *D10B 2331/021* (2013.01); *D10B 2101/20* (2013.01)
USPC ..... 57/212

(58) Field of Classification Search
USPC ..... 57/212, 214, 215, 216, 222
See application file for complete search history.

(56) References Cited

U.S. PATENT DOCUMENTS

| | | | |
|---|---|---|---|
| 3,063,966 | A | 11/1962 | DuPont |
| 3,767,756 | A | 10/1973 | Blades |
| 3,869,429 | A | 3/1975 | Blades |

(Continued)

FOREIGN PATENT DOCUMENTS

| | | | |
|---|---|---|---|
| DE | 102007024020 | A1 * | 11/2008 |
| EP | 1036235 | | 5/2003 |
| GB | 1 535 105 | A | 12/1978 |

OTHER PUBLICATIONS

PCT International Search Report and Written Opinion, PCT/US2011/044123, Jul. 15, 2011.

(Continued)

*Primary Examiner* — Shaun R Hurley

(57) ABSTRACT

A composite hybrid cord comprising a core comprising of a first bundle of synthetic filaments having a filament tenacity of from 10 to 40 grams per decitex and a plurality of cabled strands helically wound around the core, each cabled strand comprising of a plurality of metal strands helically wound around a center second bundle of synthetic filaments that have a filament tenacity of from 10 to 40 grams per decitex. The ratio of the largest cross sectional dimension of the first bundle of synthetic filaments to the largest cross sectional dimension of the second bundle of synthetic filaments is from 1.5:1 to 20:1. The metallic filaments of the cabled strands have an elongation at break that is no more than 24 percent different from the elongation at break of the synthetic filaments of the first and second bundles.

18 Claims, 1 Drawing Sheet

(56) References Cited

U.S. PATENT DOCUMENTS

| | | | | |
|---|---|---|---|---|
| 3,869,430 | A | 3/1975 | Blades | |
| 4,034,547 | A * | 7/1977 | Loos | 57/211 |
| 4,176,705 | A | 12/1979 | Russell et al. | |
| 4,807,680 | A | 2/1989 | Weidenhaupt et al. | |
| 4,878,343 | A | 11/1989 | Weidenhaupt et al. | |
| 4,887,422 | A * | 12/1989 | Klees et al. | 57/220 |
| 5,551,498 | A | 9/1996 | Komatsuki | |
| 6,779,950 | B1 * | 8/2004 | Hutchins | 405/259.1 |
| 8,079,208 | B2 * | 12/2011 | Volpi | 57/222 |
| 8,176,718 | B2 * | 5/2012 | Ridge et al. | 57/212 |
| 8,375,692 | B2 * | 2/2013 | Rebouillat et al. | 57/210 |
| 2005/0183808 | A1 | 8/2005 | Barguet et al. | |
| 2009/0159171 | A1 | 6/2009 | Volpi | |

OTHER PUBLICATIONS

Anonymous, "Reinforcing cord for elastomeric articles", Research Disclosure, Mason Publications, Hampshire, GB, vol. 159, No. 55, Jul. 1, 1977.

Anonymous: "Aramid/steel cords for rubber reinforcement", Research Disclosure, Mason Publications, Hampshire, GB, vol. 344, No. 69, Dec. 1, 1992.

* cited by examiner

COMPOSITE CORD AND METHOD OF MAKING AND SUPPORT STRUCTURE AND TIRE CONTAINING SAME

BACKGROUND OF THE INVENTION

1. Field of the Invention

The present invention relates to the field of cords useful for the reinforcement of support structures in elastomeric and rubber articles.

2. Description of the Related Art

Combinations of aramid fibers and metal strands have been disclosed in several publications, including U.S. Pat. Nos. 5,551,498; 4,176,705; 4,807,680; 4, 878, 343 and United States Patent Application Publication 2009/0159171. Continued improvements in areas such as the adhesion of cords to rubber, strength retention and durability, of cords and lighter weight support structures comprising cords are highly desirable. This invention addresses these objectives.

BRIEF SUMMARY OF THE INVENTION

This invention relates to a composite hybrid cord, and a support structure and a tire comprising the cord, the composite hybrid cord comprising a core comprising a first bundle of synthetic filaments having a filament tenacity of from 10 to 40 grams per decitex (9 to 36 grams per denier) and a plurality of cabled strands helically wound around the core, each cabled strand comprising of a plurality of metal strands helically wound around a center second bundle of synthetic filaments that have a filament tenacity of from 10 to 40 grams per decitex; and wherein the ratio of the largest cross sectional dimension of the first bundle of synthetic filaments to the largest cross sectional dimension of the second bundle of synthetic filaments is from 1.5:1 to 20:1. The metallic filaments of the cabled strands have an elongation at break that is no more than 24 percent different from the elongation at break of the synthetic filaments of the first and second bundles.

This invention also relates to a method of forming a composite cord, comprising the steps of:

a) forming or providing a first bundle of synthetic filaments having a filament tenacity of from 10 to 40 grams per decitex;

b) forming or providing a second bundle of synthetic filaments having a filament tenacity of from 10 to 40 grams per decitex; wherein the ratio of the largest cross sectional dimension of the first bundle of synthetic filaments to the largest cross sectional dimension of the second bundle of synthetic filaments is in the range of from 1.5:1 to 20:1;

c) helically winding a plurality of metal strands around the second bundle of synthetic filaments to form a cabled strand having a center of synthetic filaments wherein the metallic filaments of the cabled strands have an elongation at break that is no more than 24 percent different from the elongation at break of the synthetic filaments of the first and second bundles, and d) helically winding a plurality of the cabled strands around the first bundle of synthetic filaments to form a composite hybrid core having a core of synthetic filaments.

DETAILED DESCRIPTION OF THE INVENTION

Composite Hybrid Cord

This invention relates to a composite hybrid cord. By "hybrid" it is meant the cord contains at least two different strength materials. By "composite" it is meant the cord contains cabled strands wrapped or wound around a core. As used herein a "strand" is either a single continuous metal filament or wire; or multiple continuous metal filaments or wires that are twisted, intermingled, roved or assembled together to form a cable that can be handled and wound similarly to a single continuous metal filament or wire. A "cabled strand" as used herein represents a plurality of metal strands wound around a center bundle of filaments. By "bundle of filaments" is meant an assembly of filaments, generally in the form of one multifilament yarn or a combination of two or more multifilament yarns.

"Filament" as used herein means a relatively flexible, macroscopically homogeneous body having a high ratio of length to width across its cross-sectional area perpendicular to its length. The filament cross section can be any shape, but in preferred embodiments is round or essentially round. The cross sections of the synthetic and metallic filaments may be the same or different. The synthetic fiber may contain filaments having different cross sections. Wire having different cross sections may also be used. The cross sectional shape can be changed during processing depending on the processing conditions before, during, or after the manufacturing of the filament, the yarn, the strand, the cord or the article. Tensioning, flattening, molding or passing through a calibrated die are among the means available to tailor the cross-sectional shape. Herein, the term "fiber", with respect to synthetic material, is used interchangeably with the term "filament". The term "wire", with respect to metal, may also be used interchangeably with the term "filament".

The synthetic filaments and wire may be continuous, semi-continuous or discontinuous. Suitable examples include, but are not limited to, staple filament or wire, stretch-broken filament or wire, wire or filament made of any form based on short fibres.

Figure 1:
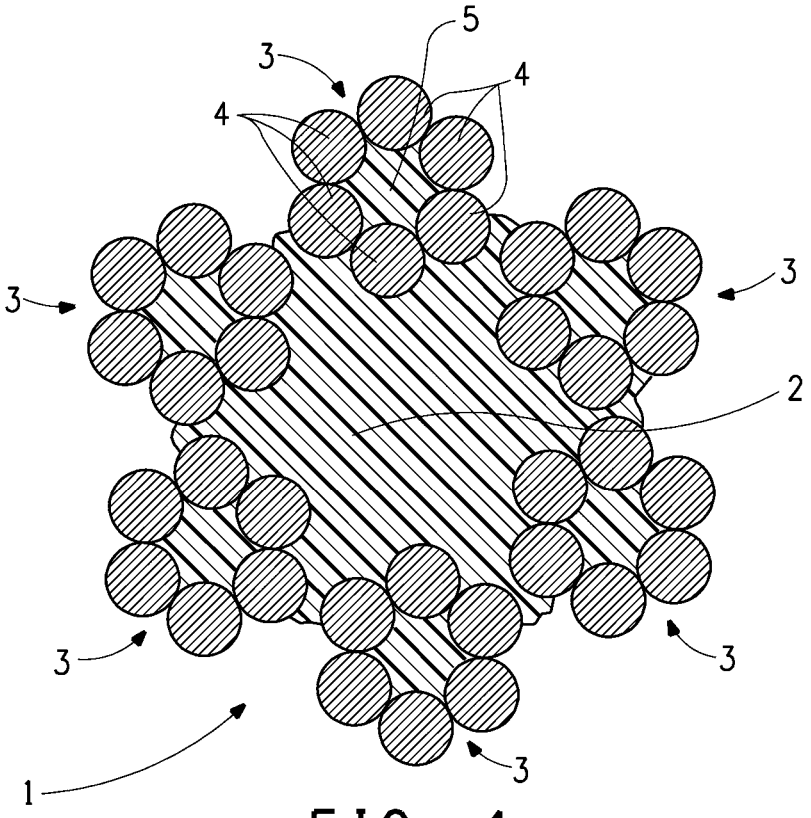
FIG. 1 is an illustration of one preferred embodiment of a composite hybrid cord.

As shown by a cross section in FIG. 1, the composite hybrid cord 1 comprises a core of a first bundle of synthetic filaments 2 and a plurality of cabled strands 3 helically wound around the core, each cabled strand comprising of a plurality of metal strands 4 helically wound around a center second bundle of synthetic filaments 5.

Synthetic Filaments of First and Second Bundles

The core of the composite hybrid cord consists of a first bundle of synthetic filaments that includes filaments having a filament tenacity of from 10 to 40 grams per decitex. In some other embodiments, the filament tenacity of the first bundle of synthetic filaments is from 10 to 30 grams per decitex (9 to 27 grams per denier). In yet another embodiment, the filament tenacity of the first bundle of synthetic filaments is from 10 to 27 grams per decitex (9 to 24 grams per denier). Each cabled strand wound around the core likewise has a center second bundle of synthetic filaments having a filament tenacity of from 10 to 40 grams per decitex. In some other embodiments, the filament tenacity of the second bundle of synthetic filaments is from 10 to 30 grams per decitex. In yet another embodiment, the filament tenacity of the second bundle of synthetic filaments is from 10 to 27 grams per decitex. In some embodiments, the synthetic filaments or yarns comprising the first and second bundles have an elongation at break ranging from 0.75% to 2.8% or even 1.4% to 2.6%. The type of synthetic filaments in the first bundle can be the same or different from the type of synthetic filaments in the second bundle. However, in preferred embodiments the type of synthetic filaments used in the different bundles is the same.

By synthetic filaments it is meant the filaments are made from synthetic polymers, that is, polymers that have been synthesized from various chemical monomers or are otherwise man-made polymers. In some embodiments, the synthetic filaments are aramid fibers. A preferred aramid fiber is para-aramid. By para-aramid fibers is meant fibers made from para-aramid polymers; poly(p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Another suitable fiber is one based on aromatic copolyamide prepared by reaction of terephthaloyl chloride (TPA) with a 50/50 mole ratio of p-phenylene diamine (PPD) and 3,4'-diaminodiphenyl ether (DPE). Yet another suitable fiber is that formed by polycondensation reaction of two diamines, p-phenylene diamine and 5-amino-2-(p-aminophenyl)benzimidazole with terephthalic acid or anhydrides or acid chloride derivatives of these monomers.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Fillers and/or functional additives made of mineral, organic or metallic matter can be incorporated into the polymer as long as they do not adversely affect the performance of the filaments or yarn bundles. Such additives may be micron-sized or nano-sized materials. Continuous para-aramid fibers, that is, fibers of extreme length are generally spun by extrusion of a solution of the p-aramid through a capillary into a coagulating bath. In the case of poly(p-phenylene terephthalamide), the solvent for the solution is generally concentrated sulfuric acid, the extrusion is generally through an air gap into a cold, aqueous, coagulating bath. Such processes are generally disclosed in U.S. Pat. Nos. 3,063,966; 3,767,756; 3,869,429, & 3,869,430. Para-aramid filaments and fibers are available commercially as Kevlar® fibers, which are available from E. I. du Pont de Nemours & Co., Wilmington, Del. ("herein DuPont") and Twaron® fibers, which are available from Teijin Aramid BV, Arnhem, Netherlands. In addition to continuous filaments, the fiber may also be made from staple fiber. Staple fiber is fiber having a short length for example from about 20 mm to about 200 mm. Spinning of staple fiber is a well known process in the textile art. Stretch-broken fiber may also be used. Blends of continuous filaments, staple or stretch-broken fiber may also be utilized. In one embodiment, the core comprises continuous para-aramid filaments having a modulus of from 5 to 15 N/decitex. In some other embodiments, fibers having a higher modulus, such as from 1 to 360 N/decitex may be used.

One or more filament yarns may be used to make up the first bundle of synthetic filaments used for the core. The core may have any suitable cross-sectional shape before being wound with the cabled strands; however, once the core is wound with the cabled strands, it can take on a more complex cross-sectional shape, such as the multi-pointed star shape shown in FIG. 1. In one embodiment, the core has an essentially round cross-section. In another embodiment the core has an essentially elliptical cross-section.

An example of a yarn that can be used as the core strand is a poly(paraphenylene terephthalamide) continuous multifilament yarn having a linear density of about 30-30000 decitex or about 1000-10000 decitex, or even about 1500-4000 decitex. In some embodiments, the core is comprised of one or more continuous multifilament yarns each having linear densities of about 1600-3200 decitex.

Figure 2A:
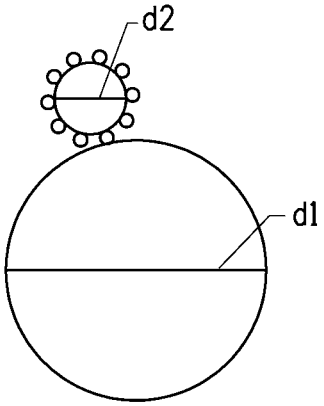
FIGS. 2A and 2B are further cross-sections of exemplary composite hybrid cords of this invention.
Figure 2B:
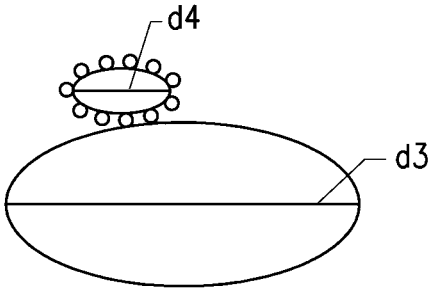

The first and second bundles may be of any suitable cross sectional shape. In some embodiments, the cross section is round, oval or bean shaped. The largest cross sectional dimension of the bundle is a convenient dimension for showing the dimensional relationship between the first and second bundles. The ratio of the largest cross sectional dimension of the first bundle of synthetic filaments to the largest cross sectional dimension of the second bundle of synthetic filaments is in the range of 1.5:1 to 20:1 or even from 3:1 to 10:1. FIG. 2A shows a substantially circular shaped first bundle of synthetic filaments having a largest cross sectional dimension d1 and one cabled strand on the perimeter of the first bundle. The cabled strand comprises a substantially circular-shaped second bundle of synthetic filaments having a largest cross-sectional dimension d2 surrounded by a plurality of wire strands. FIG. 2B shows a substantially oval shaped first bundle of synthetic filaments having a largest cross sectional dimension d3 and one cabled strand on the perimeter of the first bundle. The cabled strand comprises a substantially oval-shaped second bundle of synthetic filaments having a largest cross-sectional dimension d4 surrounded by a plurality of wire strands. Accordingly, the ratio of d1:d2 and d3:d4 is in the range of 1.5:1 to 20:1.

Filaments based on carbon, glass or ceramic may also be present in the first and/or second bundles.

Cabled Strands

A plurality of cabled strands is helically wound around the first bundle of synthetic filaments that form the core of the composite hybrid cord. In addition, each cabled strand consists of a plurality of metal strands that are helically wound around a center bundle of filaments that is the second bundle of synthetic filaments as described previously. In one embodiment, the plurality of metal strands forms an effective complete cover of the center second bundle of synthetic filaments. This is believed to help the adhesion of the composite hybrid cord to the elastomer that is being reinforced by mitigating any affects or lessening the need for any special treatments to facilitate the adhesion between the synthetic filaments and the elastomer. In other embodiments, the number of metal strands wound around the second bundle of filaments is selected so as to cover at least 30 percent of the second bundle of filaments. In another embodiment, the metal strands cover at least 75 percent or even 95 percent of the second bundle of filaments. Coverage greater than 95% of the second bundle of synthetic filaments is considered to be an effective complete covering. The number of metal strands that forms the plurality needed to form an effective complete cover of the center second bundle of filaments is dependent on many factors, including the desired cord design, the cross-sectional dimensions of the metal strands and the cross-sectional dimensions of the center bundle of synthetic filaments. In some embodiments, from two to ten metal strands form a cabled strand. In some embodiments, the number of cabled strands wound around the core is four or more. In some embodiments, the number of cabled strands wound around the core can be as high as twenty.

In another embodiment, the number of cabled strands wound around the core first bundle of filaments is selected such that the cabled strands cover at least 30 percent of the core bundle of filaments. In another embodiment, the cabled strands cover at least 75 percent or even 95 percent of the core first bundle of filaments. Coverage greater than 95% of the first bundle of synthetic filaments is considered to be an effective complete covering. It is believed this allows any resins or coatings used in the manufacture of reinforced rubber goods to fully penetrate between the cabled strands, all the way to the core of the cord, while still providing good rubber to metal adhesion. In yet another embodiment, the cabled strands cover the entire core bundle of filaments.

The preferred coverage of cabled strands over the first bundle largely depends on the chemical, morphological and the surface characteristics of the filament, yarn and strand. Similarly, the degree of coverage of cabled strands over the first bundle can be selected to tailor the level of interactions between the hybrid cord elements and the surrounding environment. The surrounding environment includes materials such as rubber, elastomer, thermoset polymers, thermoplastic polymers or combinations thereof. For example, in one embodiment, the polymeric filament may exhibit better adhesion to the rubber when compared to the adhesion of wire to rubber. In some embodiments, the cabled strands are helically wound around the core at a helical angle of from 0 to 45 degrees or from 5 to 30 degrees or even from 18 to 25 degrees in order to promote good matching of elongation at break between the core and the cabled strands. In some embodiments, the cabled strands are helically wound at a helical angle of from 10 to 20 degrees. The helical angle is the angle formed by the path of a cabled strand in relation to the major axis of the core. The expression helix angle is used equivalently with helical angle. The selection of the helical angle is dependent on the elongation properties of the selected materials. For example, if the selected materials have low elongation properties, then too high a helical angle can cause severe damage in use. Likewise, in some embodiments, the metal strands can be helically wound around the center second bundle of synthetic filaments at a helical angle suitable to provide similar elongations at break between the metallic filaments and the synthetic filaments in the first and second bundles. Suitable helical angles are from 0 to 45 degrees or from 5 to 30 degrees or even from 8 to 25 degrees. In another embodiment, the helical angle is from 10 to 20 degrees.

The metal strands used in the cabled strands can consist of a continuous single wire or may consist of multiple continuous wires twisted, intermingled, roved or assembled together. The metal strands may also be formed from staple and/or stretch-broken wires. The wires can be linear, non-linear, zig-zag or in the form of two-dimensional or three-dimensional structures. The wires can have any suitable cross-sectional shape, such as elliptical, round or star-shaped. In some embodiments, channels or groves are formed into the wire using a die. Such grooves are formed along the length of the wire and may be in the form of straight lines or cut helically around the wire. The grooves facilitate the flow of rubber or cord treating agent around the wire and aid adhesion between the rubber and the wire. In some embodiments, the metal wire is steel. In one embodiment, the elongation at break of the metal wire is no greater than 24% different from the elongation at break of the synthetic fiber in first and second bundles. In another embodiment, the difference is no greater than 15% and in yet another embodiment, the difference is no greater than 10%. Ideally, the elongations at break of the synthetic filaments and metallic filaments are the same. Typical values for elongation at break of the steel wire are in the range of from 2.3 to 5.7%. In some embodiments, the elongation at break of the steel wire is from 2.4 to 4.8%. A composite hybrid cord structure in which the elongations at break of the components of the cord are the same or within 24% of each other optimizes the mechanical efficiency of the cord under conditions of use. A process as described in European Patent (EP) 1036235 B1 is one way of producing metallic wire having a predetermined elongation at break. Crimped wires of this type are available from N. V. Bekaert S. A., Zwevegem, Belgium ("herein Bekaert") under the tradename High Impact Steel.

The wires are typically provided with a coating conferring affinity for rubber. Preferred coatings are copper, zinc and alloys of such metals, for example, brass.

The individual metal wires used as filaments in the strands can have a diameter of about 0.025 mm to 5 mm. In some embodiments, wires having a diameter of 0.10 mm to 0.25 mm are preferred. In some embodiments, so-called "fine steel", which has a diameter of about 0.04 mm to 0.125 mm are preferred.

The first bundle of synthetic filaments and/or the cabled strands may be chemically treated to provide additional functionality to the cord. Depending on the use and the environment, suitable treatments include, but are not limited to, lubricants, water barrier coatings, adhesion promoters, conductive materials, anti-corrosion agents and chemical resistance enhancers. In some embodiments, a resorcinol formaldehyde latex (RFL) coating is used as an adhesion promoter and/or a stress buffering gradient that is well suited for rubber-to-fabric textile bonding. In other embodiments, thermoplastic polyester elastomer or fluoropolymer treatments are used. A suitable polyester elastomer is HYTREL®. A suitable fluoropolymer is TEFZEL®. The materials may also include micron scale as well as nano scale formulated organic or mineral ingredients. Such materials may also be sacrificial in nature, that is, they are consumed or removed or modified during or after processing. Methods for applying such treatments are well known in the art and include extrusion, pultrusion, solution coating, melt or powder coating or pretreatment with etching, plasma, corona and other electrostatic discharges. For example, chemical acid treatment of the aramid components can enhance adhesion without significant loss of strength.

This invention also relates to a method of forming a composite hybrid cord, comprising the steps of:

a) forming or providing a first bundle of synthetic filaments having a filament tenacity of from 10 to 40 grams per decitex;

b) forming or providing a second bundle of synthetic filaments having a filament tenacity of from 10 to 40 grams per decitex; wherein the ratio of the largest cross sectional dimension of the first bundle of synthetic filaments to the largest cross sectional dimension of the second bundle of synthetic filaments is from 1.5:1 to 20:1;

c) helically winding a plurality of metal strands around the second bundle of synthetic filaments to form a cabled strand having a center of synthetic filaments wherein the metallic filaments of the cabled strands have an elongation at break that is no more than 24 percent different from the elongation at break of the synthetic filaments of the first and second bundles, and d) helically winding a plurality of the cabled strands around the first bundle of synthetic filaments to form a composite hybrid core having a core of synthetic filaments.

The first bundle of synthetic filaments can be formed by combining a plurality of synthetic multifilament yarns to form the desired core. Separately or concurrently, a plurality of cabled strands can be formed by combining the desired number of metal strands and the second bundle of synthetic filaments and helically winding the metal strands around the second bundle of synthetic filaments such that the second bundle of synthetic filaments are positioned in the center of the cabled strand. Preferably, the number and size of metal strands and the cross-sectional dimension of the second bundle of filaments are selected such that the metal strands form an effective complete covering of the center second bundle of synthetic filaments.

A plurality of these cabled strands is then helically wound around the core of first bundle of synthetic filaments to form the composite hybrid cord. In one embodiment, the number and size of cabled strands and the largest dimension of the first bundle of filaments are selected such that the cabled strands do not completely cover the core first bundle of filaments. In other instances, the amount of coverage will be selected depending the desired cord performance and on the level of interaction needed between the synthetic filaments, the wire and the rubber or elastomeric environment. Such performance characteristics include fatigue and stress buffering.

Conventional cabling machines can be used to produce the cabled strands and the composite hybrid cords.

The composite hybrid cord is useful for reinforcing an elastomeric, thermoset, thermoplastic or rubber composition including combinations thereof. Such compositions find use in tires, belts, hoses, reinforced thermoplastic pipes, ropes, cables, tubes, multi-layer or flat structures and other reinforced articles. The compositions may be partially or totally reticulated depending on the desired hardness and/or stress buffering of the rubber. Tires containing composite hybrid cords may be used in automobiles, trucks, vehicles for the construction and mining industries, motorcycles and sport and recreational vehicles. In comparison to pure steel reinforcement cord, the composite hybrid cord can contribute to a reduction in weight of the tire and can help improve the overall efficiency and durability of the tire.

To incorporate the composite hybrid cord into a tire, one or more cords are incorporated into an elastomeric or rubber matrix to form a support structure. Exemplary support structures include, but are not limited to, a carcass, a cap-ply, a bead reinforcement chafer (a composite strip for low sidewall reinforcement) and a belt strip. The matrix can be any elastomeric, thermoset, thermoplastic or rubber material and combinations thereof that can keep multiple cords in a fixed orientation and placement with respect to each other. Suitable matrix materials include both natural rubber, synthetic natural rubber and synthetic rubber. Synthetic rubber compounds can be any which are capable of dispersion, for example in latex, or dissolvable by common organic solvents. Rubber compounds can include, among many others, polychloroprene and sulfur-modified chloroprene, hydrocarbon rubbers, butadiene-acrylonitrile copolymers, styrene butadiene rubbers, chlorosulfonated polyethylene, fluoroelastomers, silicone rubbers, polybutadiene rubbers, polyisoprene rubbers, butyl and halobutyl rubbers and the like. Natural rubber, styrene butadiene rubber, polyisoprene rubber and polybutadiene rubber are preferred. Mixtures of rubbers may also be utilized. The support structure is then fitted into the structure of the tire, for example under the tread.

EXAMPLES

In the following Examples, the p-aramid fiber used was from DuPont under the tradename KEVLAR®. Steel wire was obtained from Bekaert.

The following examples are given to illustrate the invention and should not be interpreted as limiting it in any way Examples prepared according to the process or processes of the current invention are indicated by numerical values. Control or Comparative Examples are indicated by letters.

Prophetic Examples

Example A

A core was made of three Kevlar®29 yarns (the first bundle), each yarn having a linear density of 3300 decitex, a tenacity of 25.5 grams per decitex, a modulus of 629 grams per decitex and an elongation at break of 3.5%. A cabled strand was made of six ST grade steel wires the wires having a diameter of 0.256 mm and an elongation at break of 2.49% helically wrapped around Kevlar® 29 yarn (the second bundle). Yarns of the second bundle had a linear density of 800 decitex, a tenacity of 26.7 grams per decitex, a modulus of 808 grams per decitex and an elongation at break of 3.3%. The wires formed a helical angle of 12 degrees around the second bundle of filaments. Six cabled strands were wrapped around the core at an angle of 18.7 degrees to form a composite hybrid cord. The ratio of the largest cross sectional dimension of the first bundle of synthetic filaments to the largest cross sectional dimension of the second bundle of synthetic filaments was 3.44:1. When the cord is subjected to a break test, the steel wires are predicted to break at an elongation that is 29 percent lower than the Kevlar® filaments of the first and second bundles.

Example 1

A core was made of Kevlar® 49 yarn (the first bundle) having a linear density of 9480 decitex, a tenacity of 24.2 grams per decitex, a modulus of 1044 grams per decitex and an elongation at break of 2.2%. A cabled strand was made of six ST grade steel wires the wires having a diameter of 0.256 mm and an elongation at break of 2.49% helically wrapped around Kevlar 49 yarn (the second bundle). Yarns of the second bundle had a linear density of 800 decitex, a tenacity of 26.7 grams per decitex, a modulus of 1101 grams per decitex and an elongation at break of 2.32%. The wires formed a helical angle of 12 degrees around the second bundle of filaments. Six cabled strands were wrapped around the core at an angle of 18.7 degrees to form a composite hybrid cord. The ratio of the largest cross sectional dimension of the first bundle of synthetic filaments to the largest cross sectional dimension of the second bundle of synthetic filaments was 3.44:1. When the cord is subjected to a break test, the steel wires and the Kevlar® filaments of the first and second bundles are predicted to all break at an elongation of 2.5% corresponding to a breaking force of 6971 N.

Example 2

A core was made of Kevlar® 49 yarn (the first bundle) having a linear density of 9480 decitex, a tenacity of 24.2 grams per decitex, a modulus of 1044 grams per decitex and an elongation at break of 2.2%. Prior to forming the core, the yarns were dipped in a resorcinol-formaldehyde-latex (RFL) resin bath to impregnate the yarns with 9 weight percent of the RFL coating relative to the total weight of the coated yarn. A cabled strand was made of six ST grade steel wires the wires having a diameter of 0.256 mm and an elongation at break of 2.49% helically wrapped around Kevlar® 49 yarn (the second bundle). Yarns of the second bundle had a linear density of 800 decitex, a tenacity of 26.7 grams per decitex, a modulus of 1101 grams per decitex and an elongation at break of 2.32%. The wires formed a helical angle of 12 degrees around the second bundle of filaments. Six cabled strands were wrapped around the core at an angle of 18.7 degrees to form a composite hybrid cord. The ratio of the largest cross sectional dimension of the first bundle of synthetic filaments to the largest cross sectional dimension of the second bundle of synthetic filaments was 3.44:1. When the cord is subjected to a break test, the steel wires and the Kevlar® filaments of the first and second bundles are all predicted to break at an elongation of 2.45% corresponding to a breaking force of 6622N.

Example 3

A core was made of Kevlar® 49 yarn (the first bundle) having a linear density of 9480 decitex, a tenacity of 24.2 grams per decitex, a modulus of 1044 grams per decitex and an elongation at break of 2.2%. Prior to forming the core, the yarns of the core were covered by a sleeve of an elastomeric polyester resin, HYTREL® grade 4056 from DuPont. The resin comprised 10 weight percent of the total weight of coated yarn. A cabled strand was made of six ST grade steel wires the wires having a diameter of 0.256 mm and an elongation at break of 2.49% helically wrapped around Kevlar 49 yarn (the second bundle). Yarns of the second bundle had a linear density of 800 decitex, a tenacity of 26.7 grams per decitex, a modulus of 1101 grams per decitex and an elongation at break of 2.32%. The wires formed a helical angle of 12 degrees around the second bundle of filaments. Six cabled strands were wrapped around the core at an angle of 18.7 degrees to form a composite hybrid cord. The ratio of the largest cross sectional dimension of the first bundle of synthetic filaments to the largest cross sectional dimension of the second bundle of synthetic filaments is 3.44:1. When the cord is subjected to a break test, the steel wires and the Kevlar® filaments of the first and second bundles are all predicted to break at an elongation of 2.40% corresponding to a breaking force of 6592N.

Example 4

A core was made of Kevlar® 49 yarn (the first bundle) having a linear density of 9480 decitex, a tenacity of 24.2 grams per decitex, a modulus of 1044 grams per decitex and an elongation at break of 2.2%. The core was impregnated under pressure with an ethylene tetrafluoroethylene fluoropolymer resin, TEFZEL® grade HT2183 from DuPont. The resin comprised 18 weight percent of the total weight of coated yarn. A cabled strand was made of seven ST grade steel wires the wires having a diameter of 0.256 mm and an elongation at break of 2.49% helically wrapped around Kevlar® 49 yarn (the second bundle). Yarns of the second bundle had a linear density of 800 decitex, a tenacity of 26.7 grams per decitex, a modulus of 1101 grams per decitex and an elongation at break of 2.32%. The wires formed a helical angle of 12 degrees around the second bundle of filaments. Six cabled strands were wrapped around the core at an angle of 18.7 degrees to form a composite hybrid cord. The ratio of the largest cross sectional dimension of the first bundle of synthetic filaments to the largest cross sectional dimension of the second bundle of synthetic filaments is 3.44:1. When the cord is subjected to a break test, the steel wires and the Kevlar® filaments of the first and second bundles are all predicted to break at an elongation of 2.40% corresponding to a breaking force of 6562N.

Working Examples

Example B

A core was made of three Kevlar®29 yarns (the first bundle), each yarn having a linear density of 1670 decitex, a tenacity of 21.7 grams per decitex, a modulus of 617 grams per decitex and an elongation at break of 3.5%. A cabled strand was made of fifteen HT grade steel wires the wires having a diameter of 0.105 mm and an elongation at break of 2.49% helically wrapped around Kevlar® 49 yarn (the second bundle). Yarns of the second bundle had a linear density of 1580 decitex, a tenacity of 20.4 grams per decitex, a modulus of 780 grams per decitex and an elongation at break of 2.5%. The wires formed a helical angle of 11 degrees around the second bundle of filaments. Six cabled strands were wrapped around the core at an angle of 10.9 degrees to form a composite hybrid cord. The ratio of the largest cross sectional dimension of the first bundle of synthetic filaments to the largest cross sectional dimension of the second bundle of synthetic filaments was 1.78:1. When the cord was subjected to a break test with a selected gauge length of 700 mm and a test speed of 150 mm/min, the steel wires and the Kevlar® filaments of the second bundle showed an elongation at break of 2.65% corresponding to a breaking force of 4673N. The elongation at break of 2.65% was 23.9% lower than the Kevlar® filaments of the first bundle which had an elongation at break of 3.48%.

Example 5

A core was made of three Kevlar® 49 yarn (the first bundle), each yarn having a linear density of 1580 decitex, a tenacity of 20.4 grams per decitex, a modulus of 780 grams per decitex and an elongation at break of 2.5%. A cabled strand was made of fifteen HT grade steel wires the wires having a diameter of 0.105 mm and an elongation at break of 2.49% helically wrapped around Kevlar 49 yarn (the second bundle). Yarns of the second bundle had a linear density of 1580 decitex, a tenacity of 20.4 grams per decitex, a modulus of 780 grams per decitex and an elongation at break of 2.5%. The wires formed a helical angle of 11 degrees around the second bundle of filaments. Six cabled strands were wrapped around the core at an angle of 10.9 degrees to form a composite hybrid cord. The ratio of the largest cross sectional dimension of the first bundle of synthetic filaments to the largest cross sectional dimension of the second bundle of synthetic filaments was 1.73:1. When the cord was subjected to a break test with a selected gauge length of 700 mm and a test speed of 150 mm/min, the steel wires and the Kevlar® filaments of the first and second bundles had an elongation at break of 2.6% corresponding to a breaking force of 4682N.

Example 6

A core was made of Kevlar® 49 yarn (the first bundle) having a linear density of 9480 decitex, a tenacity of 19.7 grams per decitex, a modulus of 740 grams per decitex and an elongation at break of 2.2%. Prior to forming the core, the yarns were dipped in a resorcinolformaldehyde-latex (RFL) resin bath to impregnate the yarns with 9 weight percent of the RFL coating relative to the total weight of the coated yarn. A cabled strand was made of six ST grade steel wires the wires having a diameter of 0.256 mm and an elongation at break of 2.49% helically wrapped around a similar steel wire of same description (center filament). The wires formed a helical angle of 12 degrees around the center filament. Six cabled strands were wrapped around the core at an angle of 18.7 degrees to form a composite hybrid cord. The ratio of the largest cross sectional dimension of the first bundle of synthetic filaments to the largest cross sectional dimension of the center filament was 3.44:1. When the cord was subjected to a break test with a selected gauge length of 700 mm and a test speed of 150 mm/min, the steel wires and the Kevlar® filaments of the first and second bundles had an elongation at break of 2.2% corresponding to a breaking force of 7890N.

Example 7

A core was made of Kevlar® 49 yarn (the first bundle) having a linear density of 9480 decitex, a tenacity of 19.7 grams per decitex, a modulus of 740 grams per decitex and an elongation at break of 2.2%. Prior to forming the core, the yarns of the core were covered by a sleeve of an elastomeric polyester resin, HYTREL® grade 4056 from DuPont. The resin comprised 10 weight percent of the total weight of coated yarn.

A cabled strand was made of six ST grade steel wires the wires having a diameter of 0.256 mm and an elongation at break of 2.49% helically wrapped around a similar steel wire of same description (center filament). The wires formed a helical angle of 12 degrees around the center filament. Six cabled strands were wrapped around the core at an angle of 18.7 degrees to form a composite hybrid cord. The ratio of the largest cross sectional dimension of the first bundle of synthetic filaments to the largest cross sectional dimension of center filament is 3.44:1. When the cord was subjected to a break test with a selected gauge length of 700 mm and a test speed of 150 mm/min, the steel wires and the Kevlar® filaments of the first and second bundles had an elongation at break of 2.60% corresponding to a breaking force of 7382N.

Example 8

A core was made of Kevlar® 49 yarn (the first bundle) having a linear density of 9480 decitex, a tenacity of 19.7 grams per decitex, a modulus of 740 grams per decitex and an elongation at break of 2.2%. The core was impregnated under pressure with an ethylene tetrafluoroethylene fluoropolymer resin, TEFZEL® grade HT2183 from DuPont. The resin comprised 18 weight percent of the total weight of coated yarn. A cabled strand was made of six ST grade steel wires the wires having a diameter of 0.256 mm and an elongation at break of 2.49% helically wrapped around a similar steel wire of same description (center filament). The wires formed a helical angle of 12 degrees around the center filament. Six cabled strands were wrapped around the core at an angle of 18.7 degrees to form a composite hybrid cord. The ratio of the largest cross sectional dimension of the first bundle of synthetic filaments to the largest cross sectional dimension of the center steel filament is 3.44:1. When the cord was subjected to a break test with a selected gauge length of 700 mm and a test speed of 150 mm/min, the steel wires and the Kevlar® filaments of the first and second bundles had an elongation at break of 3.1% corresponding to a breaking force of 6628N.

The invention claimed is:

1. A composite hybrid cord comprising:

i) a core comprising a first bundle of synthetic filaments having a filament tenacity of from 10 to 40 grams per decitex; and ii) a plurality of cabled strands helically wound around the core, each cabled strand comprising of a plurality of metal strands helically wound around a center second bundle of synthetic filaments the second bundle of synthetic filaments having a filament tenacity of from 10 to 40 grams per decitex and wherein the yarns of the first and second bundles of synthetic filaments have an elongation at break ranging from 0.75% to 2.8% and wherein (a) the ratio of the largest cross sectional dimension of the first bundle of synthetic filaments to the largest cross sectional dimension of the second bundle of synthetic filaments is in the range of 1.5:1 to 20:1, and (b) the metallic filaments of the cabled strands have an elongation at break that is no more than 24 percent different from the elongation at break of the synthetic filaments of the first and second bundles.

2. The cord of claim 1, wherein the cabled strands cover from 30 to 95 percent of the first bundle of synthetic filaments.

3. The cord of claim 1, wherein the cabled strands form an effective complete cover of the first bundle of synthetic filaments.

4. The cord of claim 1, wherein the plurality of metal strands cover from 30 to 95 percent of the center second bundle of synthetic filaments.

5. The cord of claim 1, wherein the plurality of metal strands forms an effective complete cover of the center second bundle of synthetic filaments.

6. The cord of claim 1, wherein the first and second bundle of synthetic filaments are aramid filaments.

7. The cord of claim 1, wherein the first and second bundle of synthetic filaments are poly(paraphenylene terephthalamide) filaments.

8. The cord of claim 1, wherein the synthetic filaments of the first and second bundles have a tensile modulus of from 5 to 15 N/decitex.

9. The cord of claim 1, wherein the plurality of metal strands comprises steel wire having a diameter of from 0.04 mm to 5 mm.

10. The cord of claim 1, wherein the ratio of the largest cross sectional dimension of the first bundle of synthetic filaments to the largest cross sectional dimension of the second bundle of synthetic filaments is in the range of 3:1 to 10:1.

11. The cord of claim 1, wherein the metallic filaments comprise grooves.

12. A support structure for a tire comprising the composite hybrid cord of claim 1 in the form of a belt, a carcass, a bead, or a cap-ply.

13. A tire comprising the composite hybrid cords of claim 1.

14. A reinforcement structure for a rubber article comprising the composite hybrid cords of claim 1.

15. A method of forming a composite hybrid cord, comprising the steps of:

a) forming or providing a first bundle of synthetic filaments having a filament tenacity of from 10 to 40 grams per decitex;

b) forming or providing a second bundle of synthetic filaments having a filament tenacity of from 10 to 40 grams per decitex; and wherein the yarns of the first and second bundles of synthetic filaments have an elongation at break ranging from 0.75% to 2.8% and wherein the ratio of the largest cross sectional dimension of the first bundle of synthetic filaments to the largest cross sectional dimension of the second bundle of synthetic filaments is from 1.5:1 to 20:1;

c) helically winding a plurality of metal strands around the second bundle of synthetic filaments to form a cabled strand having a center of synthetic filaments wherein the metallic filaments of the cabled strands have an elongation at break that is no more than 24 percent different from the elongation at break of the synthetic filaments of the first and second bundles and d) helically winding a plurality of the cabled strands around the first bundle of synthetic filaments to form a composite hybrid cord having a core of synthetic filaments.

16. The method of forming a cord of claim 15, wherein the first and second bundle of synthetic filaments are aramid filaments.

17. The method of forming a cord of claim 15, wherein the first and second bundle of synthetic filaments are poly(paraphenylene terephthalamide) filaments.

18. The method of forming a cord of claim 15, wherein the synthetic filaments have a tensile modulus of from 5 to 15 N/decitex.

* * * * *